US005567446A

United States Patent [19]

Enomoto et al.

[11] Patent Number: 5,567,446

[45] Date of Patent: Oct. 22, 1996

[54] SLIP SUPPLY SYSTEM

[75] Inventors: Takeo Enomoto; Toshiya Abe; Hironobu Murakami; Shinichi Hiraki, all of Kitakyushu, Japan

[73] Assignee: Toto Ltd., Fukuoka-ken, Japan

[21] Appl. No.: 456,865

[22] Filed: Jun. 1, 1995

[30] Foreign Application Priority Data

Jun. 3, 1994 [JP] Japan ..... 6-122780

[51] Int. Cl.[6] ..... B28B 1/26

[52] U.S. Cl. ..... 425/84; 264/39; 264/86; 264/297.9; 264/328.1; 264/333; 425/86; 425/215; 425/225; 425/449

[58] Field of Search ..... 425/84, 85, 86, 425/215, 217, 225, 447, 449; 264/39, 86, 87, 297.9, 328.1, 333

[56] References Cited

U.S. PATENT DOCUMENTS 2,026,624 1/1936 Flower ..... 264/86
3,190,494 6/1965 Derror .
3,476,847 11/1969 Drever et al. ..... 425/86
4,798,525 1/1989 Sato et al. ..... 264/86
5,069,609 12/1991 Ito et al. ..... 425/86
5,083,911 1/1992 Hisaeda et al. ..... 425/84

*Primary Examiner*—Jay H. Woo
*Assistant Examiner*—Joseph Leyson
*Attorney, Agent, or Firm*—Birch, Stewart, Kolasch & Birch, LLP

[57] ABSTRACT

A slip supply system for supplying slip to one or more casting molds includes a slip supply pipe 2 to which the base ends of pouring hoses 3 each having a pouring valve 4 are connected. The ends of the pouring hoses 3 are detachably connected to casting molds 1. A slip discharge pipe 20 having communicating holes 22 is laid in the vicinity of the slip supply pipe 2. The ends of the pouring hoses 3 are removed from the casting molds 1 and connected to the communicating ports 22 before supplying slip to the casting molds 1. Slip is fed in this condition, so that the solid matters attached to the interior of the slip supply pipe 2 and the interiors of the pouring hoses 3 are washed away to the slip discharge pipe 20. Thereafter, the ends of the pouring hoses 3 are connected to the casting molds 1 to feed slip to the casting molds 1.

2 Claims, 2 Drawing Sheets

SLIP SUPPLY SYSTEM

BACKGROUND OF THE INVENTION

1. Field of the Invention

This invention relates to a slip supply system for supplying slip to one or more casting molds in the slip casting for a piece of sanitary ware or the like. More particularly, the invention is directed to a system which allows an increase in quality of the cast-molded products of slip and an effective utilization of discharged slip.

2. Description of the Background Art

In the slip casting using a plaster mold, the number of casting operations per day is generally limited to two or three times because of the characteristics of plaster and, moreover, one or two hours are required for each casting cycle. For these reasons, a system is proposed for mass production in which, using a casting apparatus shown in FIG. 3, casting operations of slip are simultaneously performed in a plurality of casting molds, thereby ensuring the number of molded products per cycle.

This casting apparatus includes a slip supply pipe 2 laid below a plurality of casting molds 1, and pouring hoses 3 which branch off from the slip supply pipe 2 each connected to a slip supply and discharge port (not shown) of the casting mold 1 through a pouring valve 4.

A slip supply source valve 5 is provided at the upstream side of the slip supply pipe 2, and a head tank 6 for the supply of slip is connected to the upstream side thereof. Slip is supplied to the head tank 6 for the supply of slip by way of a slip main pipe 7 and a slip main pipe valve 8 from a slip supply source (not shown), and the slip main pipe valve 8 is adapted to be controlled by means of a device (not shown) for detecting a level of slip in the tank 6.

Moreover, a slip discharge valve 9 is provided at the downstream side of the slip supply pipe 2, and is further connected at the downstream side thereof to a slip discharge tank 10.

At the top of each casting mold 1 is provided a pressurized air supply port 11, to which a pressurized air supply source 14 is connected through a pressurized air pipe 13 having a pressurized air valve 12. Further, a vent valve 15 is provided in the pressurized air pipe 13.

In the casting operation of slip, the pressurized air valve 12 and the slip discharge valve 9 are first closed and, simultaneously, the slip main pipe valve 8, slip supply source valve 5, pouring valves 4 and vent valve 15 are opened. Slip is then supplied to the interior of the casting mold 1 by the head pressure (water head pressure) of the head tank 6 for the supply of slip, and a molded product is formed after the lapse of a predetermined time.

Thereafter, the slip supply source valve 5 and vent valve 15 are closed and, simultaneously, the slip discharge valve 9 is opened and the pressurized air valve 12 is further opened to thereby discharge the slip, which is not deposited to the interiors of the casting molds 1, into the slip discharge tank 10. This is called slip discharge.

After completion of the slip discharge, the pouring valves 4 are closed and, subsequently, a hardening operation is performed in such a manner that pressurized air is supplied to the interiors of the casting molds 1 for a predetermined period of time to shift the moisture of the molded products to the casting molds 1, causing the water content of the molded products to be reduced. After completion of this hardening operation, the molded products are removed from the casting molds 1 and the following cycle is carried out.

In the above-described slip supply system, the interiors of the slip supply pipe 2 and pouring hoses 3 become substantially empty after completion of the slip discharge, with slip being attached to the inner walls of the pipes. Since time is taken until the following pouring cycle, the attached slip becomes dry and solidifies and, at the time of the following casting operation, the solidified slip is peeled off by the slip supplied from the head tank 6 for the supply of slip and mixes into the slip, introducing air into the slip. Thus, the slip containing solid matter and air therein is poured into the plaster molds.

As a result, the molded product includes solid matter and pin-holes produced by the introduced air, which cause a deterioration in quality and a decrease in yield of the molded products.

Further, there is a problem in that since the solid matter also mixes into the discharged slip such discharge slip cannot be recovered and utilized as it is. The discharge slip requires a discharged slip treatment by additional equipment, thus making it impossible to effectively utilize the discharged slip.

SUMMARY OF THE INVENTION

Accordingly, it is an object of the invention to provide a slip supply system which allows an improvement in the quality of cast-molded products of slip and an increase in yield and, moreover, allows an effective utilization of the discharged slip.

It is a further object of the invention to provide a slip supply system which prevents any foreign matter from entering into the slip discharge pipe and further prevents the interior of the pipe from becoming dry.

In order to achieve the above-described object of the invention, according to the invention, there is provided a slip supply system which comprises:

means for supplying slip;

a slip supply pipe for supplying slip from said slip supply means;

one or more casting molds;

branch pipes for supplying the slip from said slip supply pipe to said casting molds, said branch pipes branching off from said slip supply pipe and being detachably connected at their ends to said casting molds; and a slip discharge pipe provided with one or more communicating ports to which the ends of said branch pipes are detachably connected, said branch pipes being removed from said casting molds and connected to said communicating ports before supplying slip to said casting molds and being connected to said casting molds after displacement of slip within said pipes.

Further, in the present invention, the communicating ports can be opened and closed by an opening and closing means.

In operation, the ends of the branch pipes are first removed from the casting molds and connected to the communicating ports of the slip discharge pipe before supplying slip to the casting molds, and a predetermined amount of slip is supplied in such a condition. Hereupon, the solid matter attached to the interior of the slip supply pipe or the interiors of the branch pipes at the time of the previous casting operation is peeled off and removed by the slip which has been supplied, and is discharged to the slip discharge pipe and, simultaneously, the interiors of the pipes are filled with fresh slip. Namely, the displacement of slip within the pipes is performed. Thereafter, the ends of the branch pipes are removed from the communicating ports and connected to the casting molds, and slip is supplied to the casting molds. This eliminates the problem of solid matter mixing into the cast-molded products and the discharged slip, and further eliminates the problem of air being introduced into the slip and pin-holes being produced. Thus, an improvement in quality and yield of the molded products can be achieved and effective utilization of the discharged slip can also be made.

In addition, since in the present invention the communicating ports can be opened and closed by an opening and closing means, the prevention of foreign matter from mixing into the slip discharge pipe and of the interiors of the pipes from becoming dry can be ensured.

BRIEF DESCRIPTION OF THE DRAWINGS

Other objects and aspects of the invention will be apparent from the following description of an embodiment with reference to the accompanying drawings in which.

DESCRIPTION OF THE PREFERRED EMBODIMENTS

Now, the present invention will be explained with reference to the drawings.

Figure 1:
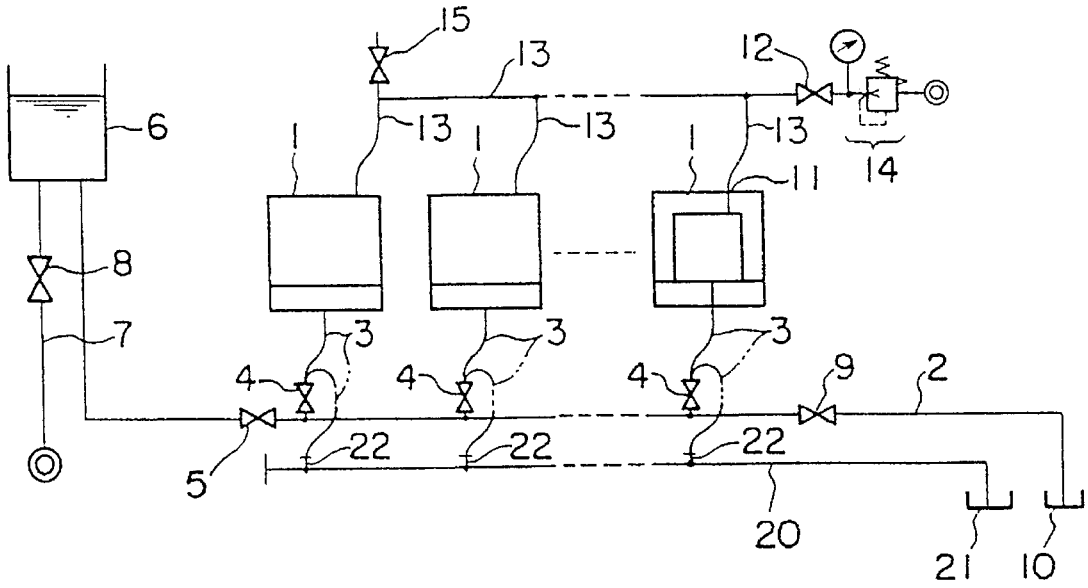
FIG. 1 is a composite view showing a slip supply system according to an embodiment of the present invention.
Figure 2:
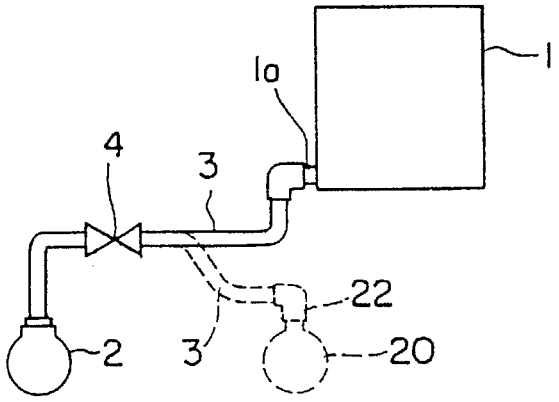
FIG. 2 is a view showing the vicinity of a pouring hose in detail.
Figure 3:
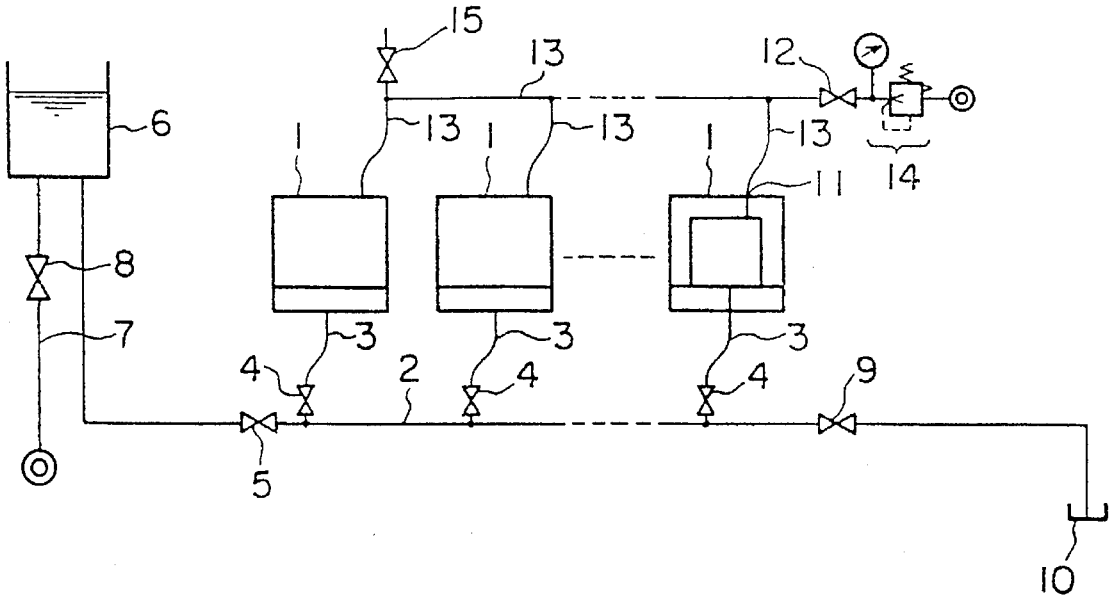
FIG. 3 is a composite view showing an example of a slip supply system.

FIGS. 1 and 2 show an example of a slip supply system according to the present invention. In the drawing, a plurality of casting molds 1 are arranged side by side, below which a slip supply pipe 2 is laid. An end of each pouring hose 3, which branch off from the slip supply pipe 2, is adapted to be detachably connected to the slip supply and discharge port 1*a* of each casting mold 1 through a pouring valve 4.

A slip supply source valve 5 is provided at the upstream side of the slip supply pipe 2, and is connected to a head tank 6 for the supply of slip at the upstream side of the slip supply source valve 5. Slip is adapted to be supplied from a slip supply source (not shown) to the head tank 6 for the supply of slip by way of a slip main pipe 7 and a slip main pipe valve 8, which is controlled by means of a device (not shown) for detecting the level of slip within the tank.

Moreover, a slip discharge valve 9 is provided at the downstream side of the slip supply pipe 2, and is connected to a slip discharge tank 10 at the downstream side of the slip discharge valve 9.

At the top of each casting mold 1 is provided a pressurized air supply port 11, to which a pressurized air supply source 14 is connected through a pressurized air pipe 13 having a pressurized air valve 12. A vent valve 15 is provided in the pressurized air pipe 13.

In the vicinity of the slip supply pipe 2 is provided a slip discharge pipe 20, which is closed at the upstream end and which is provided with a slip recovery tank 21 at the downstream side thereof.

This slip discharge pipe 20 is also provided with a plurality of communicating ports 22 corresponding to the respective pouring hoses 3. Each of the communicating ports 22 is adapted to be connected to the end of the pouring hose 3 removed from each casting mold 1. before supplying slip to the casting molds 1

Next, the operation of the slip supply system of the present embodiment will be explained.

Displacement of the slip within the pipes is performed before supplying slip to each casting mold 1. For the displacement of the slip, the end of each pouring hose 3 is removed from the slip supply and discharge port 1*a* of each casting mold 1, and is connected to each of the communicating ports 22 of the slip discharge pipe 20.

The slip supply source valve 5 is subsequently opened and slip is fed under pressure using the head pressure of the head tank 6 for the supply of slip. The slip which is fed under pressure is recovered in the slip recovery tank 21 through the slip supply pipe 2, pouring hose 3 and slip discharge pipe 20.

Performing the feed of the slip under pressure for a predetermined period of time allows the solid matter attached to the interior of the slip supply pipe 2 and the interiors of the pouring hoses 3 to be washed away by the slip which is fed under pressure and, simultaneously, results in the interior of the slip supply pipe 2 and the interiors of the pouring hoses 3 being filled with fresh slip which is stable in property. Namely, the displacement of slip has been performed within the pipes. Hereupon, the slip supply source valve 5 is closed.

The end of each pouring hose 3 is subsequently removed from the communicating port 22 and is connected to the slip supply and discharge port 1*a* of each casting mold 1. Thereafter, a casting cycle is performed by supplying slip to the casting molds 1 according to the same process as the conventional process.

Further, it is preferable to close each communicating port 22 using a rubber plug during a molding cycle in order to prevent any foreign matter from mixing into the slip discharge pipe 20 and prevent the interiors of the pipes from becoming dry. Moreover, a manual type or automatic type of opening and closing valve may be used in place of the rubber plug.

In this way, the present embodiment allows the quality and yield of the molded products to be improved, since solid matter and air do not mix into the slip supplied to the interior of the casting molds 1.

In addition, no foreign matter mixes into the slip discharged into the slip discharge pipe 20 and, therefore, the provision of a device for removing foreign matter in the equipment for preparation of the recovered slip is not required.

As described above, since in the slip supply system according to the invention the displacement of slip within the pipes is performed before supplying slip to the casting molds, foreign matter and air do not mix into the slip supplied to the interiors of the casting molds, and the casting operation can be performed using the slip which is stable in property, thereby allowing the quality and yield of the molded products to be improved. Further, as no solid matter mixes into the undeposited slip which is discharged at the time of slip discharge, the undeposited slip can effectively be re-utilized.

Moreover, since in the present invention the communicating ports can be opened and closed by the opening and closing means, the prevention of foreign matter from mixing into the slip discharge pipe and the interiors of the pipes becoming dry during a molding cycle can be ensured, and no process and equipment for removing foreign matter are required when re-utilizing the discharge slip and, simultaneously, the pipes are prevented from clogging.

What is claimed is:

1. A slip supply system which comprises:

means for supplying slip;

a slip supply pipe for supplying slip from said slip supply means;

one or more casting molds;

branch pipes for supplying the slip from said slip supply pipe to said casting molds, said branch pipes branching off from said slip supply pipe and being detachably connected at their ends to said casting molds; and a slip discharge pipe provided with one or more communicating ports to which the ends of said branch pipes are detachably connected, said branch pipes being removed from said casting molds and connected to said communicating ports before supplying slip to said casting molds and being connected to said casting molds after displacement of slip within said pipes.

2. A slip supply system as claimed in claim 1, wherein said communicating ports of said slip discharge pipe are adapted to be opened and closed by an opening and closing means.

* * * * *